United States Patent [19]

Kay et al.

[11] 4,397,683

[45] Aug. 9, 1983

[54] DESULFURIZATION OF FLUID MATERIALS

[75] Inventors: D. Alan R. Kay, Burlington, Canada; William G. Wilson, Pittsburgh, Pa.

[73] Assignee: Union Oil Company of California, Los Angeles, Calif.

[21] Appl. No.: 174,024

[22] Filed: Jul. 31, 1980 (Under 37 CFR 1.47)

Related U.S. Application Data

[60] Continuation-in-part of Ser. No. 31,531, Apr. 19, 1979, Pat. No. 4,224,058, which is a division of Ser. No. 838,945, Oct. 3, 1977, Pat. No. 4,161,400, which is a continuation-in-part of Ser. No. 705,525, Jul. 15, 1976, Pat. No. 4,084,960, and a continuation-in-part of Ser. No. 838,888, Oct. 3, 1977, which is a continuation-in-part of Ser. No. 705,525, Jul. 15, 1976, Pat. No. 4,084,960.

[51] Int. Cl.[3] ..... C22C 33/08

[52] U.S. Cl. ..... 75/58; 75/53; 75/130 R

[58] Field of Search ..... 75/53, 58, 130 R

[56] References Cited

U.S. PATENT DOCUMENTS

| | | | |
|---|---|---|---|
| 3,360,364 | 12/1967 | Ivey | 75/130 R |
| 4,018,597 | 4/1977 | Staggers | 75/58 |
| 4,224,063 | 9/1980 | Peregudov | 75/58 |

OTHER PUBLICATIONS

Webster's Seventh New Collegiate Dictionary, p. 809, (1966).

*Primary Examiner*—Peter D. Rosenberg
*Attorney, Agent, or Firm*—Dean Sandford; Gregory F. Wirzbicki; Robert A. Franks

[57] ABSTRACT

A method for desulfurizing fluid materials, comprising reacting sulfur to be removed with a rare earth compound, thereby forming rare earth sulfides, oxysulfides or mixtures thereof. The reaction is conducted under conditions of low oxygen potential. Rare earth sulfides and oxysulfides can be reacted with oxygen to restore a capacity for desulfurization.

24 Claims, 7 Drawing Figures

Fig. I.
$h_S$, Wt.%
$h_O$, Wt.%
$P_{CO}$ atm.
APPROX. [% S]
CeS
$Ce_3S_4$
$Ce_2S_3$
$Ce_2O_2S$
$Ce_2O_3$
m= 1/2
m=5/6
m=1
m=1
A
B'
C'
B
C
D
E Fig. 2a X-ray sulphur microprobe image.

Fig. 2b Optical micrograph 200X.

DESULFURIZATION OF FLUID MATERIALS

CROSS-REFERENCE TO RELATED APPLICATIONS

This application is a continuation-in-part of Ser. No. 031,531 filed Apr. 19, 1979 (now U.S. Pat. No. 4,224,058), which in turn is a division of Ser. No. 838,945, filed Oct. 3, 1977 (now U.S. Pat. No. 4,161,400), which in turn is a continuation-in-part of Ser. No. 705,525, filed July 15, 1976 (now U.S. Pat. No. 4,084,960); and also is a continuation-in-part of copending Ser. No. 838,888, filed Oct. 3, 1977, which in turn is a continuation-in-part of Ser. No. 705,525, filed July 15, 1976 (now U.S. Pat. No. 4,084,960). Each of the aforementioned applications and patents is hereby incorporated by reference.

BACKGROUND AND SUMMARY OF THE INVENTION

This invention relates to methods of desulfurizing fluid materials and, more particularly, to a method of externally desulfurizing fluids such as molten iron and steel, stack gases, coal gases, coal liquification products, and the like using rare earth compounds, including such materials as rare earth oxides, rare earth fluorocarbonates or rare earth oxyfluorides, in an essentially dry process.

The term "rare earth", as used herein, includes the lanthanide rare earth elements having atomic numbers from 57 to 71, inclusive, and the element yttrium, atomic number 39, which is commonly found in rare earth concentrates and acts similarly to the rare earths in chemical separations.

As indicated above, this method is adapted to the desulfurization of essentially any fluid material. We shall, however, discuss the method in connection with two of the most pressing problems of desulfurization which industry presently faces; i.e., the desulfurization of molten iron and steel baths and the desulfurization of stack gases.

External desulfurization of molten iron and steel has been practiced for quite some time. It is a recognized, even necessary, practice in much of the iron and steel produced today. In current practices for the desulfurization of iron and steel it is common to add magnesium metal, magcoke, calcium oxide, calcium carbide or mixtures of calcium oxide and calcium carbide as the desulfurizing agent. Unfortunately, there are serious problems, as well as major cost items involved, in the use of all of these materials for desulfurization. Obviously, both calcium oxide and calcium carbide must be stored under dry conditions, since calcium oxide will hydrate and calcium carbide will liberate acetylene on contact with moisture. Magnesium is, of course, highly incendiary and must be carefully stored and handled. There are also further problems associated with the disposal of spent desulfurization slags containing unreacted calcium carbide.

We have found that these storage, material handling and disposal problems are markedly reduced by using rare earth compounds in a low oxygen content bath of molten iron or steel. The process is adapted to the desulfurization of pig iron or steel where carbon monoxide, evolved by the reaction where carbon is used as a deoxidizer, is diluted, either with an inert gas such as nitrogen or by vacuum degassing the melt, in order to reduce the oxygen potential and thereby increase the efficiency of the reaction by reducing the likelihood of forming oxysulfides, The principle may also be used for desulfurizing stack gases from boilers, etc., as shall be discussed in more detail hereafter.

In desulfurizing molten iron and steel in the practice of this invention, it is preferable to follow the steps of reacting rare earth oxide, rare earth oxyfluorides, rare earth fluorocarbonates and mixtures thereof (including bastnasite concentrates), in the presence of a deoxidizing agent, with the sulfur to be removed, to form one of the group consisting of rare earth sulfide and rare earth oxysulfide and mixtures thereof.

Preferably, hot metal is treated in a ladle or transfer car with rare earth compounds, by the simple addition and mixing of the rare earth compounds, by an injection technique in which the rare earth compounds are injected into the molten bath in a carrier gas such as argon or nitrogen, or by the use of an "active lining"; i.e., a rare earth compound lining in the vessel. In any case, the chemical reactions involved may be shown as follows, where the term RE indicates "rare earth":

$$2CeO_{2(s)}+[C]=Ce_2O_{3(s)}+CO_{(g)} \quad (1)$$

$$RE_2O_{3(s)}+[C]+[S]_{1w/o}=RE_2O_2S_{(s)}+CO_{(g)} \quad (2)$$

and $$RE_2O_2S_{(s)}+2[C]+2[S]_{1w/o}=RE_2S_3+2CO_{(g)} \quad (3)$$

The product sulfide or oxysulfide can either be fixed in an 'active' lining or removed by flotation and absorbed into the slag cover and vessel lining, depending upon the process used for introducing the rare earth compound.

The products of desulfurization of carbon saturated iron with rare earth oxides is dependent on the partial pressure of CO, pCO, and the Henrian sulfur activity in the metal, $h_S$. Using cerium as the representative rare earth, the following standard free energy changes and the equilibrium constants at 1,500° C. for different desulfurization reactions can be calculated from thermodynamic data in the literature:

| REACTION | ΔG° cal. | $K_{1773}$ |
|---|---|---|
| $2CeO_{2(s)} + [C] = Ce_2O_{3(s)} + CO_{(g)}$ | 66000 − 53.16T | pCO = 3041 |
| $Ce_2O_{3(s)} + [C] + [S]_{1w/o} = Ce_2O_2S_{(s)} + CO_{(g)}$ | 18220 − 26.43T | $pCO/h_S = 3395$ |
| $Ce_2O_2S_{(s)} + 2[C] + 2[S]_{1w/o} = Ce_2S_{3(s)} + 2CO_{(g)}$ | 66180 − 39.86T | $p^2CO/h_S^2 = 3.6$ |
| $3/2Ce_2O_2S_{(s)} + 3[S] + 5/2[S]_{1w/o} = Ce_3S_{4(s)} + 3CO_{(g)}$ | 127050 − 72.1T | $p^3CO/h_S^{5/2} = 1.25$ |
| $Ce_2O_2S_{(s)} + 2[C] + [S]_{1w/o} = 2CeS_{(s)} + 2CO_{(g)}$ | 120,860 − 61.0T | $p^2CO/h_S = .027$ |
| $C_{(s)} + \frac{1}{2}O_{2(g)} = CO_{(g)}$ | −28200 − 20.16T | $pCO/p^{\frac{1}{2}}O_2 = 7.6 \times 10^{-7}$ |

-continued

| REACTION | ΔG° cal. | $K_{1773}$ |
|---|---|---|
| $\frac{1}{2}S_{2(g)} = [S]_{1w/o}$ | −31520 + 5.27T | $h_S/1^{\frac{1}{2}}S_2 = 5.4 \times 10^2$ |

The thermodynamics of desulfurization with lanthanum oxide, $La_2O_3$, are similar although, in this case, $LaO_2$ is unstable and there will be no conversion corresponding to $CeO_2 \rightarrow Ce_2O_3$.

In the case of desulfurization of gases, such as stack gases, assume the following gas composition at 1,000° C.:

| Component | Vol. % |
|---|---|
| $CO_2$ | 16 |
| CO | 40 |
| $H_2$ | 40 |
| $N_2$ | 4 |
| $H_2S$ | 0.3 |
| | (200 grains/100 ft.$^3$) |

This equilibrium gas composition is represented by point A on the diagram illustrated as FIG. 6 where $CO/CO_2 = 2.5$ and $H_2/H_2S = 133$. This point lies within the $Ce_2O_2S$ phase field and at constant $CO/CO_2$ desulfurization with $Ce_2O_3$ will take place up to point B. At point B, $H_2/H_2S \approx 10^4$ and the concentration of $H_2S$ is 0.004 vol.% (~3 grains/100 ft.$^3$). Beyond this point, desulfurization is not possible.

The basic theory for this invention is supported by the standard free energies of rare earth compounds likely to be involved. Examples of these appear in Table I which follows:

TABLE I

Standard Free Energies of Formation of Some Rare Earth Compounds: ΔG° = X − YT cal/g.f.w.

| Reaction | X | Y | Temp. (°K.) | Estimated Error (Kcal) |
|---|---|---|---|---|
| $CeO_{2(s)} = Ce_{(l)} + O_{2(g)}$ | 259,900 | 49.5 | 1071–2000 | ±3 |
| $Ce_2O_{3(s)} = 2Ce_{(l)} + 3/2\ O_{2(g)}$ | 425,621 | 66.0 | 1071–2000 | ±3 |
| $La_2O_{3(s)} = 2La_{(l)} + 3/2\ O_{2(g)}$ | 428,655 | 68.0 | 1193–2000 | ±3 |
| $CeS_{(s)} = Ce_{(l)} + \frac{1}{2}\ S_{2(g)}$ | 132,480 | 24.9 | 1071–2000 | ±2 |
| $Ce_3S_{4(s)} = 3Ce_{(l)} + 2S_{2(g)}$ | 483,180 | 98.2(*) | 1071–2000 | ±10 |
| $Ce_2S_{3(s)} = 2Ce_{(l)} + 3/2\ S_{2(g)}$ | 351,160(*) | 76.0(*) | 1071–2000 | ±10 |
| $LaS_{(s)} = La_{(l)} + \frac{1}{2}\ S_{2(g)}$ | 123,250 | 25.3 | 1193–2000 | ±6 |
| $Ce_2O_2S_{(s)} = 2Ce_{(l)} + O_{2(g)} + \frac{1}{2}\ S_{2(g)}$ | 410,730 | 65.0 | 1071–2000 | ±15 |
| $La_2O_2S_{(s)} = 2La_{(s)} + O_{2(g)} + \frac{1}{2}\ S_{2(g)}$ | 407,700(*) | 65.0(*) | 1193–2000 | ±15 |

(*)Estimated

The three phase equilibria at 1273° K. for the Ce—O—S System is set out in Table II as follows:

TABLE II

Ce—O—S System
Three Phase Equilibria at 1273° K.

| REACTION | ΔG° cal | $K_{1273}$ |
|---|---|---|
| $Ce_2O_{3(s)} + \frac{1}{2}\ S_{2(g)} = Ce_2O_2S_{(s)} + \frac{1}{2}\ O_{2(g)}$ | 14890 − 1.0T | $(pO_2/pS_2)^{\frac{1}{2}} = 4.6 \times 10^{-3}$ |
| $Ce_2O_2S_{(s)} + \frac{1}{2}\ S_{2(g)} = 2CeS_{(s)} + O_{2(g)}$ | 145770 − 15.2T | $pO_2/p^{\frac{1}{2}}S_2 = 2.0 \times 10^{-22}$ |
| $3Ce_2O_2S_{(s)} + 5/2\ S_{2(g)} = 2Ce_3S_{4(s)} + 3O_{2(g)}$ | 265830 + 1.4T | $p^3O_2/p^{5/2}S_2 = 1.1 \times 10^{-46}$ |
| $Ce_2O_2S_{(s)} + S_{2(g)} = Ce_2S_3 + O_{2(g)}$ | 59570 + 11.0T | $pO_2/pS_2 = 2.3 \times 10^{-13}$ |
| $Ce_3S_{4(s)} = 3CeS_{(s)} + \frac{1}{2}\ S_{2(g)}$ | 85740 − 23.5T | $p^{\frac{1}{2}}S_2 = 2.5 \times 10^{-10}$ |
| $2Ce_2S_{3(s)} = 2Ce_3S_{4(s)} + \frac{1}{2}\ S_{2(g)}$ | 87120 − 31.6T | $p^{\frac{1}{2}}S_2 = 8.9 \times 10^{-8}$ |
| $CO_{(g)} + \frac{1}{2}\ O_{2(g)} = CO_{2(g)}$ | −67500 + 20.75T | $pCO_2/(pCO \cdot p^{\frac{1}{2}}O_2) = 1.1 \times 10^7$ |
| $H_{2(g)} + \frac{1}{2}\ S_{2(g)} = H_2S_{(g)}$ | −21580 + 11.80T | $pH_2S/(pH_2 \cdot p^{\frac{1}{2}}S_2) = 13.4$ |
| $H_{2(g)} + \frac{1}{2}\ O_{2(g)} = H_2O_{(g)}$ | −58900 + 13.1T | $pH_2O/(pH_2 \cdot p^{\frac{1}{2}}O_2) = 1.8 \times 10^7$ |

Typical calculations of energy changes involved in the systems involved in this invention are as follows:

$S_{2(g)} + Ce_2O_2S_{(s)} = Ce_2S_{3(s)} + O_{2(g)}$ $Ce_2S_{3(s)} = 2Ce_{(l)} + 3/2\ S_{2(g)}$: ΔG° = 351160 − 76.0T cal $Ce_2O_2S_{(s)} = Ce_{(l)} + O_{2(g)} + \frac{1}{2}\ S_{2(g)}$: ΔG° = 410730 − 65.0T cal $Ce_2O_2S_{(s)} + S_{2(g)} = Ce_2S_{3(s)} + O_{2(g)}$: ΔG° = 59570 + 11.0T cal @ 1273° K. ΔG° = 73573 cal and $pO_2/pS_2 = 2.33 \times 10^{-13}$ $Ce_2O_{3(s)} + \frac{1}{2}\ S_{2(g)} = Ce_2O_2S + \frac{1}{2}\ O_{2(g)}$ $Ce_2O_{3(s)} = 2Ce_{(l)} + 3/2\ O_{2(g)}$: ΔG° = 425621 − 66.0T cal $Ce_2O_2S_{(s)} = 2Ce_{(l)} + O_{2(g)} + \frac{1}{2}\ S_{2(g)}$ L ΔG° = 410730 − 65.0T cal $Ce_2O_{3(s)} + \frac{1}{2}\ S_{2(g)} = Ce_2O_2S_{(s)} + \frac{1}{2}\ O_{2(g)}$: G° = 14891 − 1.0T cal @ 1273° K. ΔG° = 13618 cal and $(pO_2/pS_2)^{\frac{1}{2}} = 4.6 \times 10^{-3}$ $Ce_2O_2S_{(s)} + \frac{1}{2}\ S_{2(g)} = 2CeS_{(s)} + O_{2(g)}$ $Ce_2O_2S_{(s)} = 2Ce_{(l)} + \frac{1}{2}\ S_{2(g)} + O_{2(g)}$: ΔG° = 410730 − 65.0T cal $2CeS_{(s)} = 2Ce_{(l)} + S_{2(g)}$: ΔG° = 264960 − 49.8T cal $Ce_2O_2S_{(s)} + \frac{1}{2}\ S_{2(g)} = 2CeS_{(s)} + O_{2(g)}$: ΔG° = 145770 − 15.2T cal @ 1273° K. ΔG° = 126420 cal. and $pO_2/p^{\frac{1}{2}}S_2 = 1.96 \times 10^{-22}$ $3Ce_2O_2S_{(s)} + 5/2\ S_{2(g)} = 2Ce_3S_{4(s)} + 3O_{2(g)}$ $2Ce_3S_{4(s)} = 6Ce_{(l)} + 4S_{2(g)}$: ΔG° = 966360 − 196.4T cal $3Ce_2O_2S_{(s)} = 6Ce_{(l)} + 3O_{2(g)} + 3/2\ S_{2(g)}$: ΔG° = 1232190 − 195.0T cal $3Ce_2O_2S_{(s)} + 5/2\ S_{2(g)} = 2Ce_3S_{4(s)} + 3O_{2(g)}$: ΔG° = 265830 + 1.4T cal @ 1273° K. ΔG° = 267612 cal and $p^3O_2/p^{5/2}S_2 = 1.12 \times 10^{-46}$ $Ce_3S_{4(s)} = 3CeS_{(s)} + \frac{1}{2}\ S_{2(g)}$ $Ce_3S_{4(s)} = 3Ce_{(l)} + 2S_{3(g)}$: ΔG° = 48318 − 98.2T cal $3CeS_{(s)} = 3Ce_{(l)} + 3/2\ S_{2(g)}$: ΔG° = 397,440 − 74.7T cal $Ce_3S_{4(s)} = 3CeS_{(s)} + \frac{1}{2}\ S_{2(g)}$: ΔG° = 85740 − 23.5T cal @ 1273° K. ΔG° = 55824 cal $p^{\frac{1}{2}}S_2 = 2.6 \times 10^{-10}$ $3Ce_2S_{3(s)} = 2Ce_3S_{4(s)} + \frac{1}{2}\ S_{2(g)}$ $2Ce_3S_{4(s)} = 6Ce_{(l)} + 4S_{2(g)}$: ΔG° = 966360 − 196.4T cal $3Ce_3S_{3(s)} = 6Ce_{(l)} + 9/2\ S_{2(g)}$: ΔG° = 1053480 − 228.0T cal $3Ce_2S_{3(s)} = 2Ce_3S_{4(s)} + \frac{1}{2}\ S_{2(g)}$: ΔG° = 87120 − 31.6T cal @ 1273° K. ΔG° = 468893 cal and $p^{\frac{1}{2}}S_2 = 8.9 \times 10^{-9}$ $H_{2(g)} + \frac{1}{2}\ S_{2(g)} = H_2S_{(g)}$ $H_{2(g)} + \frac{1}{2}\ S_{2(g)} = H_2S_{(g)}$: ΔG° = −21580 + 11.80T cal @ 1273° K. ΔG° = −6559 and $pH_2S/(pH_2 \cdot p^{\frac{1}{2}}S_2) = 13.4$ -continued

| $pH_2/pH_2S$ | log $pS_2$ |
|---|---|
| 1 | −2.25 |
| $10^2$ | −6.25 |
| $10^4$ | −10.25 |
| $10^6$ | −14.25 |
| $10^8$ | −18.25 |
| $10^{10}$ | −22.25 |
| $10^{12}$ | −26.25 |

$H_{2(g)} + \frac{1}{2} O_{2(g)} = H_2O_{(g)}$ $H_{2(g)} + \frac{1}{2} O_{2(g)} = H_2O_{(g)}$: $\Delta G° = -58900 + 13.1T$ cal @ 1273° K. $\Delta G° = -42223$ cal and $(pH_2/pH_2O)\ p^{\frac{1}{2}}O_2 = 5.6 \times 10^{-8}$

| $pH_2/pH_2O$ | log $pO_2$ |
|---|---|
| $10^{-4}$ | −6.5 |
| $10^{-2}$ | −10.5 |
| 1 | −14.5 |
| $10^2$ | −18.5 |
| $10^4$ | −22.5 |
| $10^6$ | −26.5 |
| $10^8$ | −30.5 |

$Co_{(g)} + \frac{1}{2} O_{2(g)} = CO_{2(g)}$ $Co_{(g)} + \frac{1}{2} O_{2(g)} = CO_{2(g)}$: $\Delta G° = -67500 + 20.75T$ cal @ 1273° K. $\Delta G° = -41085$ and $pCO_2/(pCO \cdot p^{\frac{1}{2}}O_2) = 1.1 \times 10^7$

| $pCO/pCO_2$ | log $pO_2$ |
|---|---|
| $10^{-4}$ | −6.1 |
| $10^{-2}$ | −10.1 |
| 1 | −14.1 |
| $10^2$ | −18.1 |
| $10^4$ | −20.1 |
| $10^6$ | −24.1 |
| $10^8$ | −30.1 |

DETAILED DESCRIPTION

In the foregoing general description of this invention, certain objects, purposes and advantages have been outlined. Other objects, purposes and advantages of this invention will be apparent, however, from the following description and the accompanying drawings in which:

FIG. 1 is a phase stability diagram for cerium oxide, oxysulfide and sulfides in hot metal at 1500° C.;

FIGS. 2*a* and 2*b* show $Ce_2S_3$ and $Ce_2O_2S$ layers on a pellet of $CeO_2$;

Figure 1:
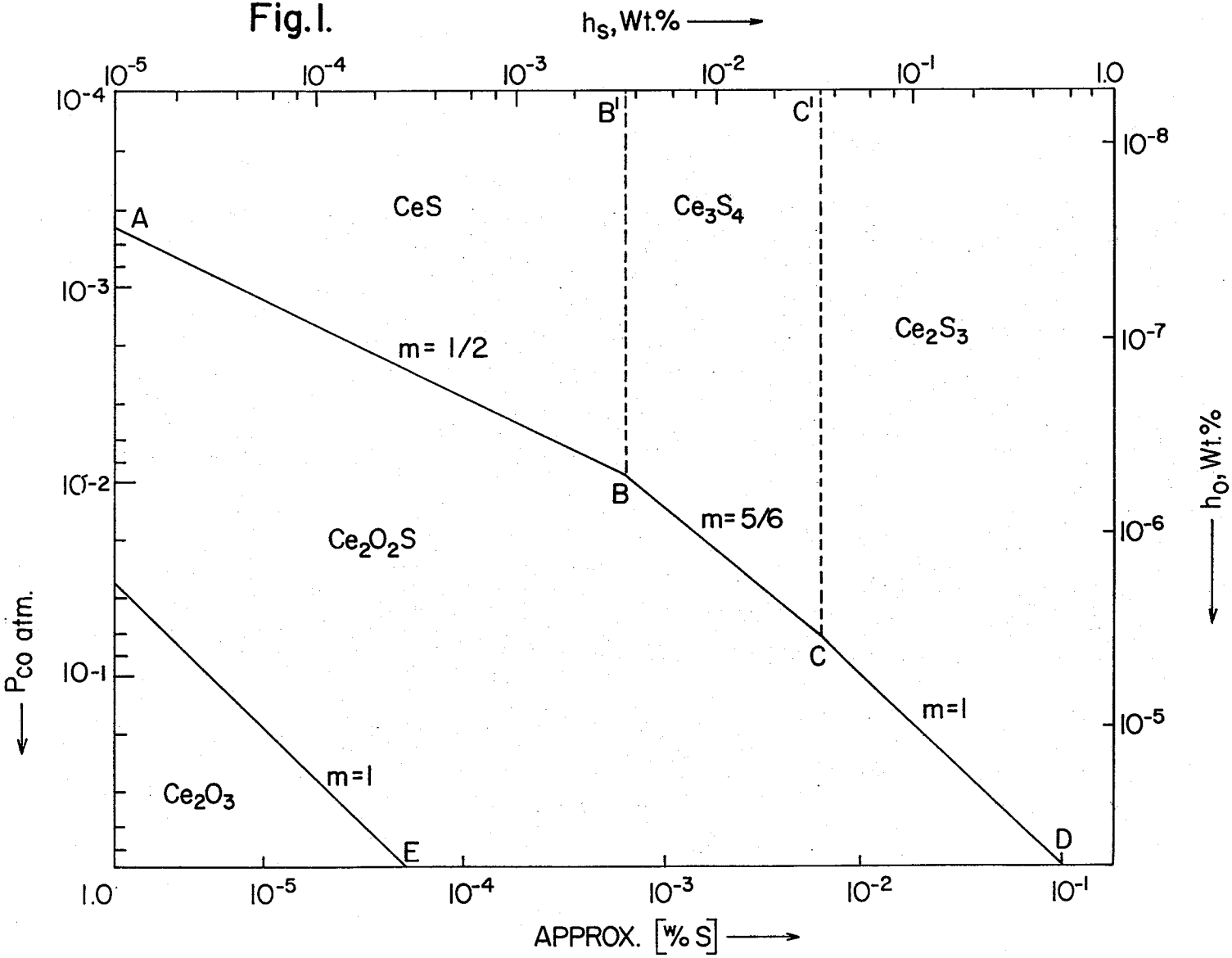

Referring back to the discussion of free energy set out above, it is clear that these free energy changes may be used to determine the fields of stability of $Ce_2O_3$, $Ce_2O_2S$, $Ce_2S_3$, $Ce_3S_4$ and CeS in terms of the partial pressure of CO and the Henrian sulfur activity of the melt at 1500° C. The resultant stability diagram is shown in FIG. 1, the boundaries between the phase fields being given by the following relationships:

| BOUNDARY | EQUATION |
|---|---|
| $Ce_2O_3 - Ce_2O_2S$ | $\log pCO = \log h_S + 3.53$ |
| $Ce_2O_2S - Ce_2S_2$ | $\log pCO = \log h_S + 0.28$ |
| $Ce_2O_2S - Ce_3S_4$ | $\log pCO = 0.83 \log h_S + 0.03$ |
| $Ce_2O_2S - CeS$ | $\log pCO = 0.5 \text{ long } h_S - 0.79$ |

-continued

| BOUNDARY | EQUATION |
|---|---|
| $Ce_2S_3 - Ce_3S_4$ | $\log h_S = -1.47$ |
| $Ce_3S_4 - CeS$ | $\log h_S = -2.45$ |

The phase fields in FIG. 1 are also shown in terms of the Henrian activity of oxygen, $h_O$, and the approximate [w/o S] in the iron melt using an activity coefficient $f_S \simeq 5.5$ for graphite saturated conditions.

The coordinates of the points B, C, D and E on the diagram are given below:

| COORDINATES | B | C | D | E |
|---|---|---|---|---|
| pCO atm. | $9.8 \times 10^{-3}$ | $6.5 \times 10^{-2}$ | 1.0 | 1.0 |
| $h_S$ | $3.5 \times 10^{-3}$ | $3.4 \times 10^{-2}$ | $5.3 \times 10^{-1}$ | $2.9 \times 10^{-4}$ |
| Approx. [w/o S] | $6.4 \times 10^{-4}$ | $6.2 \times 10^{-3}$ | $9.6 \times 10^{-2}$ | $5.3 \times 10^{-5}$ |

The points B and C represent simultaneous equilibria between the oxysulfide and two sulfides at 1500° C. These univariant points are only a function of temperature. The points E and D represent the minimum sulfur contents or activities at which oxysulfide and $Ce_2S_3$ can be formed, respectively, at pCO−1 atm. Thus, carbon saturated hot metal cannot be desulfurized by oxysulfide formation below $h_S \simeq 2.9 \times 10^{-4}$ ([w/o S]$\simeq 5.3 \times 10^{-5}$) at pCO=1 atm. However, lower sulfur levels may be attained by reducing the partial pressure of CO.

Figure 2:
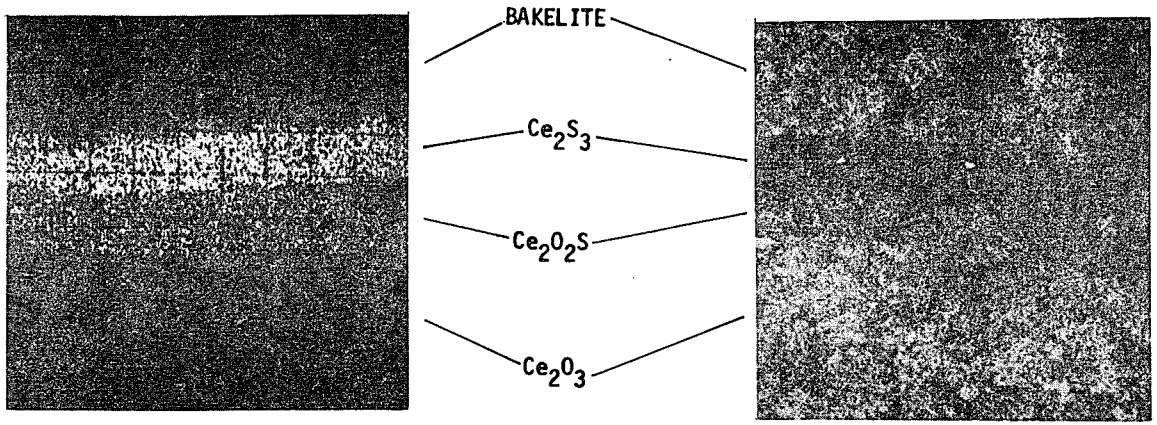

The conversion of $CeO_2 \rightarrow Ce_2O_3 \rightarrow Ce_2O_2S \rightarrow Ce_2S_3$ is illustrated in FIGS. 2*a* and 2*b* which show $Ce_2S_3$ and $Ce_2O_2S$ layers on a pellet of $CeO_2$ (which first transformed to $Ce_2O_3$) on immersion in graphite saturated iron at ~1600° C., initially containing 0.10 w/o S, for 10 hours. The final sulfur content was ~0.03 w/o S and the experiment was carried out under argon, where pCO << 1 atm.

The conversion of the oxide to oxysulfide and sulfide is mass transfer controlled and, as in conventional external desulfurization with calcium carbide, vigorous stirring will be required for the simple addition process and circulation of hot metal may be required in the 'active' lining process.

Figure 3:
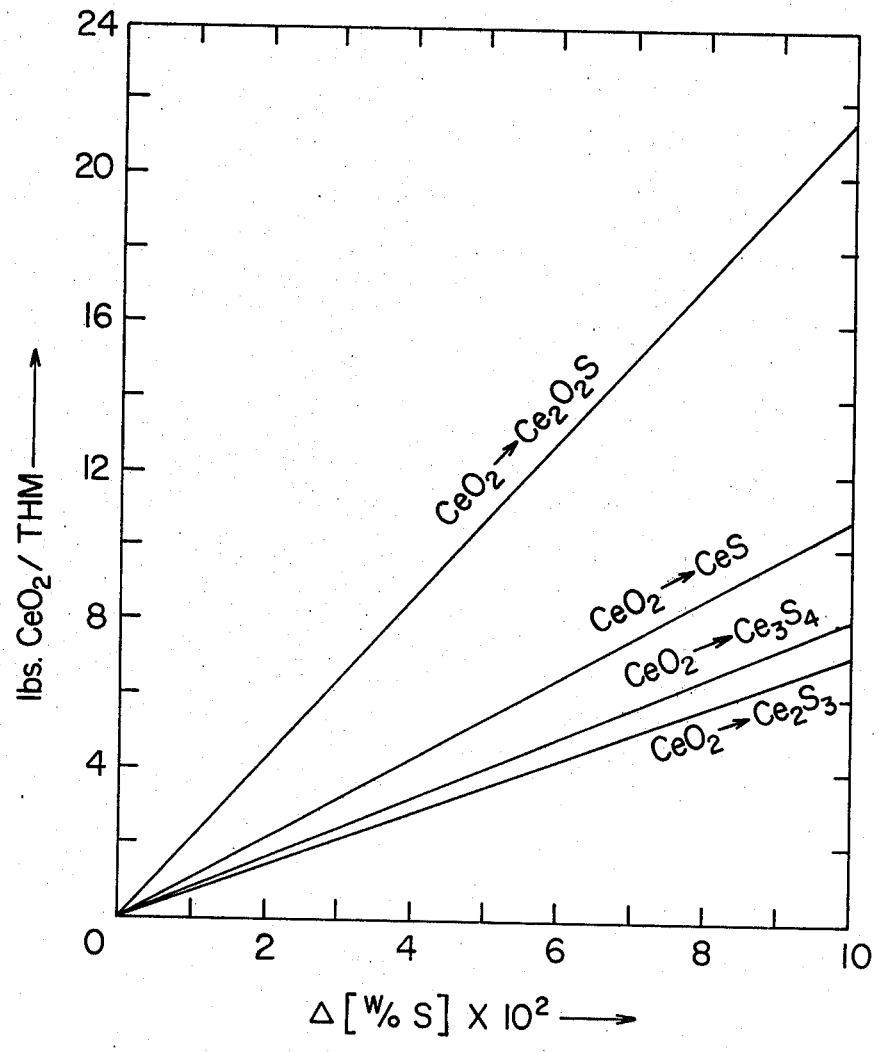
FIG. 3 is a graph of the theoretical $CeO_2$ requirement for sulfur removal in hot metal.

From FIG. 1 it is apparent that the external desulfurization of graphite saturated iron is thermodynamically possible using RE oxides. For example, the diagram indicates that hot metal sulfur levels of ~0.5 ppm (point E) can be achieved by cerium oxide addition even at pCO=1 atm. Desulfurization in this case will take place through the transformation sequence $CeO_2 \rightarrow Ce_2O_3 \rightarrow Ce_2O_2S$ which requires 2 moles of $CeO_2$ to remove 1 gram atom of sulfur. The efficiency of sulfur removal/lb. $CeO_2$ added can, however, be greatly increased by the formation of sulfides. 1 mole $CeO_2$ is required per gram atom of sulfur for CeS formation and 2/3 moles $CeO_2$ for $Ce_2S_3$ formation. The theoretical $CeO_2$ requirements for the removal of sulfur in hot metal for the various desulfurization products are given below and expressed graphically in FIG. 3. The term THM is used herein as an abbreviation for "ton of hot metal".

| PRODUCT | lb $CeO_2$/ 0.01 w/o S. THM | $ft^3$ CO/ lb $CeO_2$ | $ft^3$ CO/ 0.01 w/o S. THM |
|---|---|---|---|
| $Ce_2O_2S$ | 2.15 | 2.1 | 4.5 |
| CeS | 1.1 | 4.2 | 4.5 |

-continued

| PRODUCT | lb $CeO_2$/ 0.01 w/o S. THM | $ft^3$ CO/ lb $CeO_2$ | $ft^3$ CO/ 0.01 w/o S. THM |
|---|---|---|---|
| $Ce_3S_4$ | 0.8 | 4.2 | 3.4 |
| $Ce_2S_3$ | 0.7 | 4.2 | 3.0 |

The volume of carbon monoxide produced in $ft^3CO$/lb $CeO_2$ and $ft^3CO$/0.01 w/o S.THM are also given in the above table for each desulfurization product. For efficient desulfurization the partial pressure of carbon monoxide should be sufficiently low to avoid oxysulfide formation. For example, FIG. 1 shows that oxysulfide will not form in a graphite saturated melt until [w/o S]<0.01 when pCO≃0.1 atm. It will form however when [w/o S]≃0.10 at pCO=1 atm. Thus, by reducing the pCO in the desulfurization process at 0.1 atm, hot metal can be desulfurized to 0.01 w/o S with a $CeO_2$ addition of 0.72 lb/0.01 w/o S removed from each ton hot metal.

The choice of the method of reducing the partial pressure of carbon monoxide depends on economic and technical considerations. However, in an injection process, calculations can be made for the volume of injection gas, say nitrogen, required to produce a given pCO. Thus:

$$V_{N2}=V_{CO}(1-p\mathrm{CO})/p\mathrm{CO}$$

where $V_{CO}$ is the scf of CO formed/lb $CeO_2$ added
$V_{N2}$ is the scf of $N_2$ required/lb $CeO_2$ added and
pCO is the desired partial pressure of CO in atm.

Figure 4:
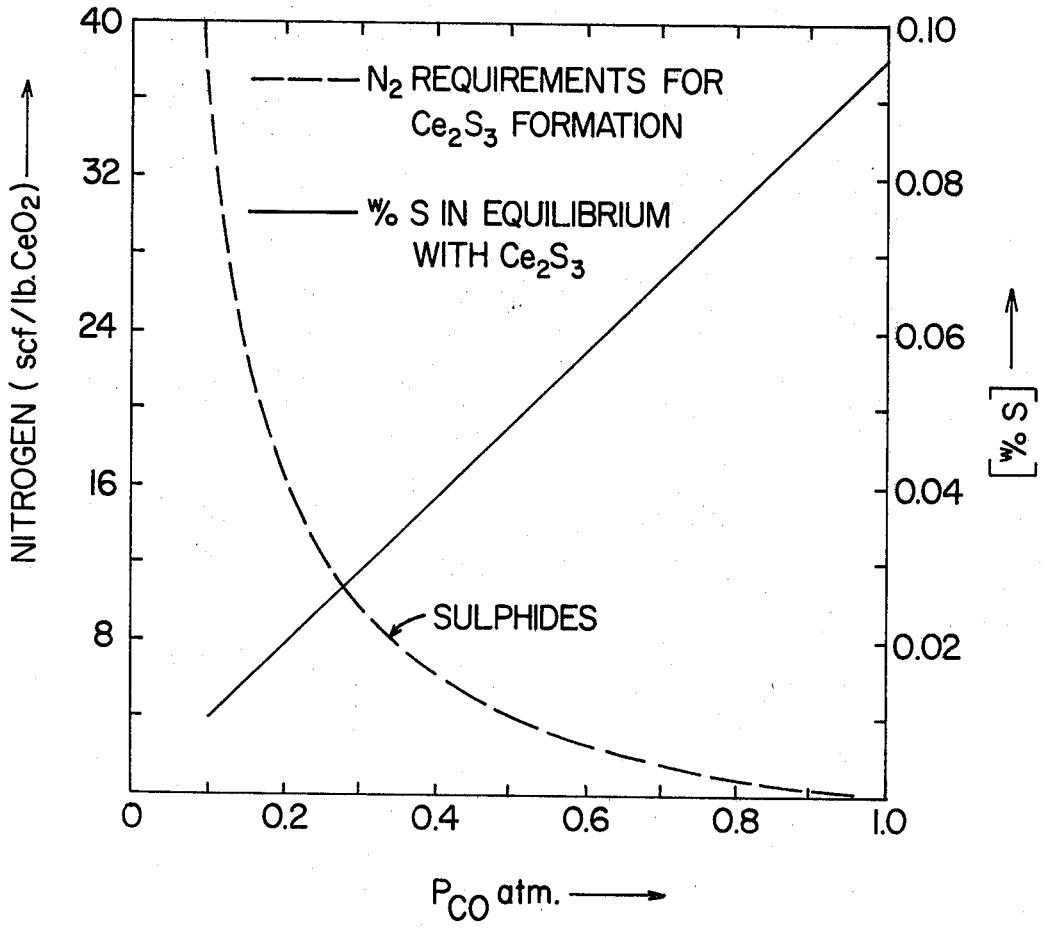
FIG. 4 is a graph showing the volume of nitrogen required to produce a given partial pressure of CO.

The results of these calculations for $Ce_2S_3$ formation are shown in FIG. 4, which also shows the [w/o S] in equilibrium with $Ce_2S_{3(s)}$ as a function of pCO. From this figure it is apparent that the volume of $N_2$/lb $CeO_2$ required to form $Ce_2S_3$ is excessive and if an injection process were used a balance would have to be struck between sulfide and oxysulfide formation. When, for example, hot metal is to be desulfurized from 0.05 to 0.01 w/o S at pCO=0.2 atm., ~16 scf $N_2$/lb $CeO_2$ would be required for $Ce_2S_3$ formation and the sulfur content would drop to 0.02 w/o. The remaining 0.01 w/o S would be removed by oxysulfide formation. From FIG. 3, it can be seen that ~2 lbs of $CeO_2$/THM would be required for $Ce_2S_3$ formation and 2 lbs for $Ce_2O_2S$ formation giving a total requirement of 4 lbs $CeO_2$/THM.

Figure 5:
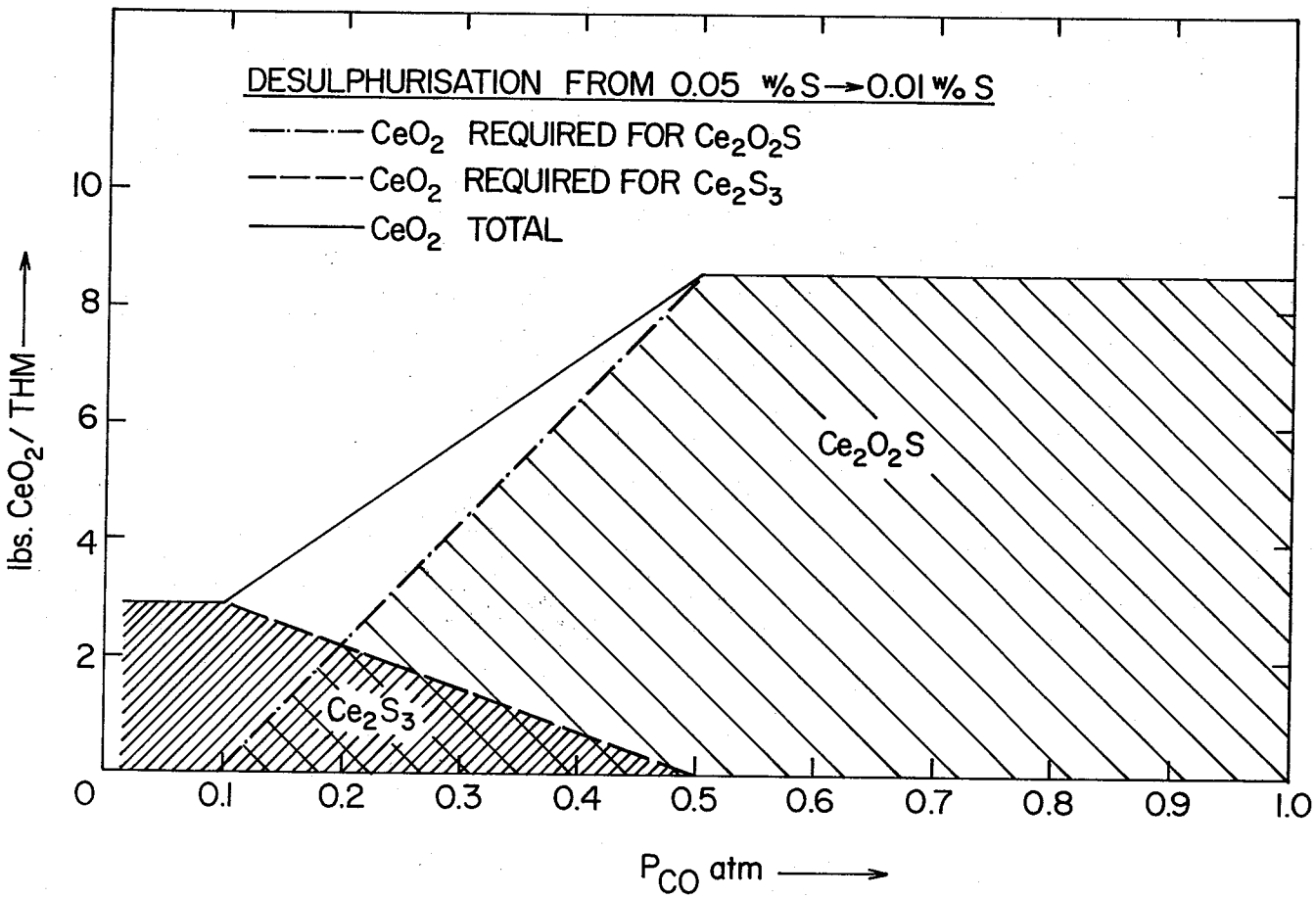
FIG. 5 is a graph showing the $CeO_2$ requirements as a function of partial pressure of CO.
Figure 6:
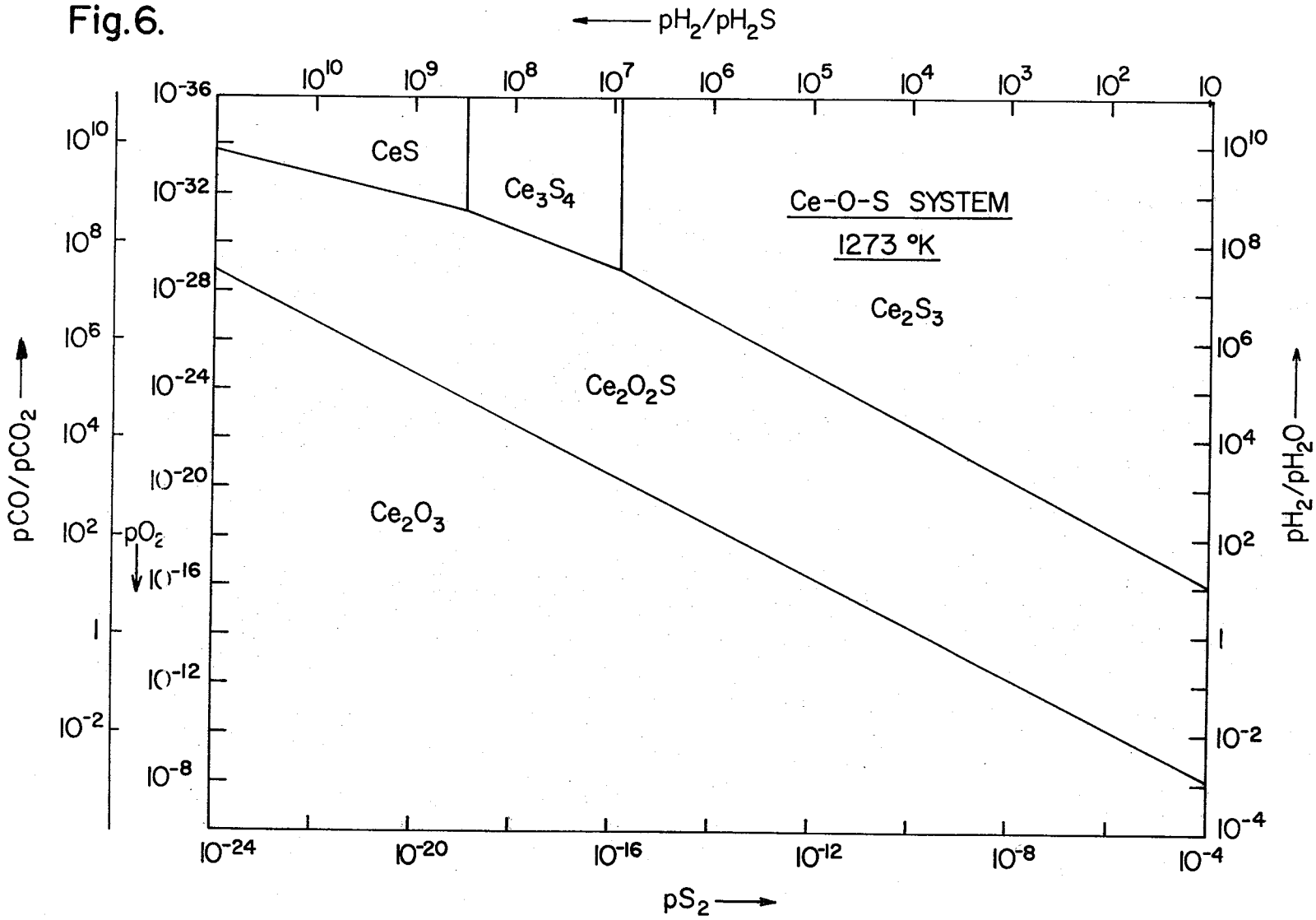
FIG. 6 is a stability diagram for stack gas systems treated according to this invention.

Calculations similar to the one above have been used to construct FIG. 5 where the $CeO_2$ requirements in lbs/THM are shown as a function of pCO.

When large volumes of nitrogen are used in an injection process the heat carried away by the nitrogen, as sensible heat, is not large but the increased losses by radiation may be excessive. Injection rates with calcium carbide, for example, are in the order of 0.1 scf $N_2$/lb $CaC_2$.

Vacuum processing is an alternative method of reducing the partial pressure of carbon monoxide. This is impractical in hot metal external desulfurization but not in steelmaking (see below).

Still another alternative approach to external desulfurization using rare earth compounds is the use of active linings which would involve the 'gunning' or flame-spraying of hot metal transfer car linings with rare earth compounds. Here the compounds would transform to oxysulfides during the transfer of hot metal from the blast furnace to the steelmaking plant, and the oxide would be regenerated by atmospheric oxidation when the car was emptied. It is estimated that for a 200 ton transfer car, conversion of a 2 mm layer (~0.080") of oxide to oxysulfide would reduce the sulfur content of the hot metal by ~0.02 w/o S. This process has the following advantages:

(1) continuous regeneration of rare earth oxide by atmospheric oxidation when the car is empty, (2) reaction times would be in the order of hours, (3) the absence of a sulfur rich desulfurization slag, and (4) the absence of suspended sulfides in the hot metal.

The mechanical integrity and the life of an "active" lining is, of course, critical and some pollution problems may be associated with oxide regeneration by atmospheric oxidation.

With regard to steelmaking applications, vacuum desulfurization could be carried out by an "active" lining in the ASEA-SKF process and circulation vacuum degassing processes.

Although a large portion of this discussion is concerned with oxides of single rare earths, it should be noted that other compositions containing mixtures of rare earths and varying amounts of non-rare earth elements and compounds can be used in the practice of the invention. For example, such low cost materials as concentrates of bastnasite, a rare earth fluorocarbonate ore, or the rare earth oxyfluorides formed by calcining bastnasite concentrates, are useful. Typical approximate weight percentage compositions for Bastnasite 4000 concentrates and acid-leached Bastnasite 4010 concentrates, produced by Molycorp, Inc., a subsidiary of Union Oil Company of California, are shown in Table III. Also shown are the calculated compositions for calcined products of the concentrates, after removal of the loss on ignition. A calcined Bastnasite 4000 is denoted "4000C", while calcined Bastnasite 4010 is denoted "4100".

TABLE III

Composition of Bastnasite Concentrates

| Component | Bastnasite Concentrate 4000 | 4000C | 4010 | 4100 |
|---|---|---|---|---|
| Contained RE* (as oxide) | 55–60 | 72–79 | 68–72 | 85–90 |
| SrO | 6.0 | 7.9 | 1.0 | 1.2 |
| CaO | 5.0 | 6.6 | 0.4 | 0.5 |
| BaO | 1.5 | 2.0 | 1.8 | 2.2 |
| F | 4.0 | 5.3 | 5.0 | 6.0 |
| $SiO_2$ | 0.4 | 0.5 | 0.4 | 0.6 |
| $Fe_2O_3$ | 0.5 | 0.7 | 0.5 | 0.6 |
| $P_2O_5$ | 0.9 | 1.2 | 1.0 | 1.2 |
| MgO, $Na_2O$, $K_2O$ (each) | <0.5 | <0.5 | <0.5 | <0.5 |
| $ThO_2$ | <0.1 | <0.1 | <0.1 | <0.1 |
| Loss on ignition (primarily $CO_2$) | 24.0 | — | 20.0 | — |

| Oxide | % of total RE |
|---|---|
| $CeO_2$ | 48–50 |
| $La_2O_3$ | 32–34 |
| $Nd_2O_3$ | 13–14 |
| $Pr_6O_{11}$ | 4–5 |
| $Sm_2O_3$ | 0.5 |
| $Gd_2O_3$ | 0.2 |
| $Eu_2O_3$ | 0.2 |
| Others | 0.2 |

*Contained RE (as oxides)

The invention is further illustrated by the following examples which are illustrative of various aspects of the invention, and are not intended as limiting the scope of the invention as defined by the appended claims.

EXAMPLE 1

An experiment demonstrating the use of rare earth compositions for desulfurizing molten iron is conducted, utilizing the "active lining" technique.

Crucibles of about 3 inches outside diameter and about 8 inches height are prepared by hand ramming lining material into the bottom, to a depth of about 0.5 inches. Walls are then constructed by ramming the lining material between the crucible wall and a cylindrical graphite former. With the former in place, the lining is sintered by heating to about 1600° C. in an induction furnace and maintaining the temperature for about one hour. Ventilation holes in the former permit any gases to escape during sintering. After removal of the former, the rare earth lining has a thickness of about 0.25 inches.

Cerium oxide, $CeO_2$, and two calcined bastnasite concentrates are used as lining materials. The two bastnasites, produced by Molycorp, Inc., are No. 4000C (unleached, calcined bastnasite) and No. 4100 (acid leached, calcined bastnasite).

The experimental procedure is as follows: a cylindrical ingot of graphite-saturated iron is placed in a lined crucible and melted in an induction furnace. Upon reaching the experimental temperature, about 1450° C., iron sulfide is added to establish the initial sulfur content. The melt is held at the experimental temperature and suction samples are taken at time intervals for sulfur analysis. After the experiment, melts are either solidified in situ or cast. Following casting, the crucibles can be re-used for desulfurization, due to the regenerative effect of air contact on the lining material.

Figure 7:
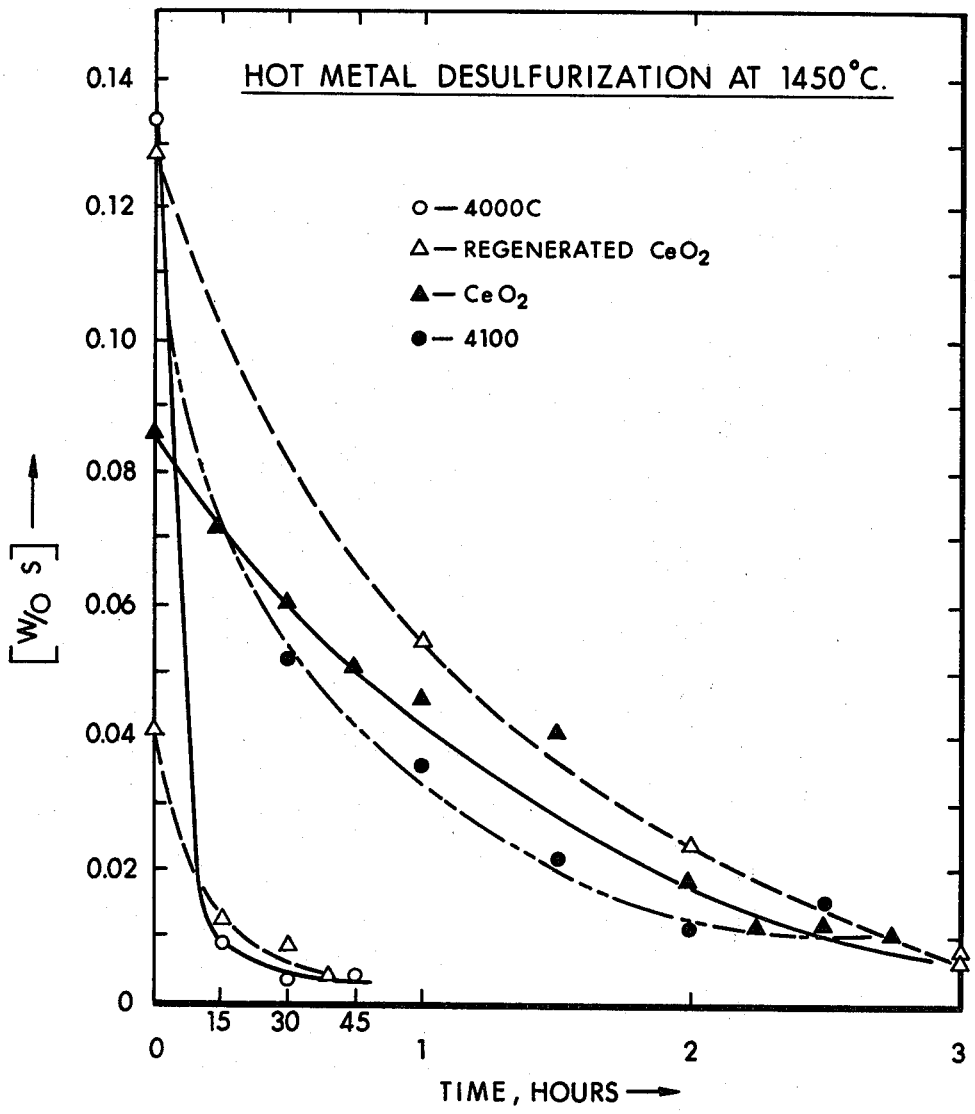
FIG. 7 is a graph showing hot metal sulfur content as a function of time for the practice of the invention as described in Example 1.

Results are shown in FIG. 7, where sulfur content is given as a function of time for melts contained within $CeO_2$, Bastnasite 4000C and Bastnasite 4100 lined crucibles.

All linings appear to be mechanically sound after use, and one $CeO_2$ lining is re-used with the results shown in FIG. 7. Some evidence of lining flaking is noted in the more refractory $CeO_2$ and Bastnasite 4100 linings, but, since Bastnasite 4000C appears to soften at about 1500° C., it is therefore not as susceptible to failure by spalling or flaking. In cases where the desulfurized iron is cast, the reacted lining appears to react and fume upon contact with air, probably because of regeneration reactions.

Subsequent experiments for desulfurizing Fe—C—Si—Mn—S melts containing about 1% by weight Si, however, indicate that the rate of sulfur removal is significantly lower for re-used linings, probably due to deposition of a surface layer of silica on the lining during regeneration. This layer presumably decreases accessibility of the rare earth compound for reaction with sulfur.

EXAMPLE 2

An experiment is performed to illustrate the use of rare earth compounds for desulfurizing gases.

Pellets of Bastnasite 4100 are prepared by mixing the powder with 10–20 percent by weight of water and pelletizing in a 40 cm diameter rubber tire pelletizer, revolving at 60 rpm, for about three minutes. Pellet size is controlled by the water content; 0.1 cm pellets result from about 10% water addition and 1 cm diameters are produced by about 20% water content in the mixture.

The pellets are dried in an oven at about 75° C. for about 5 hours, then sintered in air at about 1200° C. for approximately 7 hours. Those having a diameter of about 0.5 cm are selected for subsequent use.

Cerium in the pellets is reduced to the trivalent state by contact with hydrogen for about two hours at 800° C., to facilitate desulfurization reactions involving conversion to oxysulfide under reducing conditions.

Reduced pellets are placed in a silica reactor tube to form a fixed bed measuring approximately 4 inches diameter and 6 inches length. A thermocouple is inserted into the bed, and the tube is placed inside a tube furnace. A sulfur-containing gas, representative of coal gasification processes and containing 1.0% $H_2S$, 33.0% $H_2$, 10.8% $CO_2$ and 56.2% CO by volume, is passed through the bed at a rate of about 0.5 l/min. The $H_2S$ content of the output gas is measured as a function of temperature and time by drawing 100 ml samples through a disposable $H_2S$ Drager tube, which contains lead acetate, and reading the approximate $H_2S$ concentration in ppm by length of black lead sulfide which forms in the tube.

Results from the experiment are shown in Table IV. Ine one case, the pellets used for desulfurization at 850° C. are oxidized in situ by passing air through the bed at about 0.5 l/min. for about one hour. The pellets are reduced at about 800° C. in hydrogen and re-used for desulfurization at 850° C., as shown in the column marked "Regen-850° C.".

TABLE IV

| Time | Desulfurization of 10,000 ppm $H_2S$ Gas — $H_2S$ Content of Outlet Gas (ppm) | | | | |
|---|---|---|---|---|---|
| (min.) | 250° C. | 450° C. | 550° C. | 850° C. | Regen. −850° C. |
| 5 | <1 | <1 | <1 | <1 | <1 |
| 10 | 1600 | <1 | <1 | <1 | <1 |
| 15 | 8000 | <1 | <1 | 2 | <1 |
| 20 | — | <1 | 2 | 2 | 1300 |
| 25 | — | <1 | 3 | 2 | 2000 |
| 30 | — | 7 | 5 | 4 | 1000 |
| 35 | — | 60 | 19 | 6 | 250 |
| 40 | — | — | 55 | 7 | 250 |
| 45 | — | 1300 | 1100 | 10 | 250 |
| 50 | — | 2000 | 1600 | 13 | 200 |
| 55 | — | 5000 | 3200 | 14 | 200 |
| 60 | — | — | 4500 | — | 200 |

EXAMPLE 3

An experiment similar to that of Example 2 is performed, using pellets of Bastnasite 4000C for desulfurizing gases.

Pellets, prepared as in the preceding example, except sintered at a temperature of either 1100° C. or 1300° C., and reduced in hydrogen at 1200° C. for about 24 hours, are formed into a bed and treated as before. Two gases are used: the first is the 1.0% $H_2S$ by volume (10,000 ppm) gas of Example 2, the second is a mixture containing 2.27% $H_2S$ (22,700 ppm) and 97.73% $H_2$ by volume.

The results are shown in Table V, which correlates sulfur removal with both desulfurization conditions and preparation differences between the pellets used. The column marked "Regenerated" contains data obtained after treating the used 1300° C. pellets with air for four hours at about 1200° C., reducing with hydrogen, and repeating the previous desulfurization test.

During initial desulfurization, a layer of reaction product about 0.5 mm thick forms on the pellet surfaces. Upon regeneration, a certain amount of the surface layer exfoliates. It is possible that the improved sulfur capacity of the regenerated material may be due, in part, to exposure of the previously unreacted pellet core.

TABLE V

| Desulfurization of Gases | | | | |
|---|---|---|---|---|
| Pellet Type | Initial Use | | | Re-generated |
| Sintering (°C./hours) | 1100/5 | 1100/5 | 1300/7 | 1300/7 |
| $H_2S$ in Feed Gas (ppm) | 10,000 | 10,000 | 22,700 | 22,700 |
| Feed Gas Flow (l/min.) | 0.5 | 0.35 | 1.06 | 1.06 |
| Bed Temp. (°C.) | 850 | 1000 | 1000 | 1000 |
| Time (minutes) | $H_2S$ Content of Outlet Gas (ppm) | | | |
| 5 | <1 | 10 | 100 | 60 |
| 10 | <1 | 10 | 400 | 100 |
| 20 | <1 | <30 | 480 | 100 |
| 60 | <2 | <30 | 560 | 100 |
| 80 | <2 | <30 | 580 | 100 |
| 100 | 8 | <30 | 590 | 100 |
| 120 | 20 | <30 | 590 | 100 |
| 140 | 25 | <30 | 590 | 100 |
| 160 | 35 | <30 | 590 | 100 |
| 180 | 100 | <30 | 600 | 100 |
| 200 | — | <30 | 700 | 100 |
| 220 | — | <30 | 900 | 100 |
| 230 | — | <30++ | 1600 | — |

++No change in $H_2S$ content after 24 hours.

Various embodiments and modifications of this invention have been described in the foregoing description and examples, and further modifications will be apparent to those skilled in the art. Such modifications are included within the scope of the invention as defined by the following claims.

We claim:

1. A method for decreasing the concentration of reactive sulfur in a fluid material, comprising reacting at least a portion of the sulfur with a nonmetallic rare earth compound, at a sufficiently low oxygen potential to form one of the group consisting of rare earth sulfides, rare earth oxysulfides, and mixtures thereof.

2. The method as described in claim 1 wherein the rare earth compound is selected from the group consisting of rare earth oxides, rare earth fluorocarbonates, rare earth oxyfluorides, and mixtures thereof.

3. The method as described in claim 2 wherein rare earth fluorocarbonates comprise concentrates of bastnasite.

4. The method as described in claim 2 wherein rare earth oxyfluorides comprise roasted concentrates of bastnasite.

5. The method as described in claim 2 wherein rare earth oxyfluorides comprise acid leached, roasted concentrates of bastnasite.

6. The method as described in claim 1 wherein a low oxygen potential is obtained by introducing an inert gas.

7. The method as described in claim 1 wherein a low oxygen potential is obtained by applying a partial vacuum.

8. The method as described in claim 1 wherein a low oxygen potential is obtained by introducing a deoxidizing agent.

9. The method as described in claim 8 wherein a deoxidizing agent is carbon.

10. The method as described in claim 9 wherein carbon monoxide, produced from the oxidation of carbon, is maintained at a partial pressure below about 0.1 atmosphere.

11. The method as described in claim 1 wherein the fluid material is a liquid.

12. The method as described in claim 11 wherein the liquid comprises molten metal.

13. The method as described in claim 12 wherein the metal is iron.

14. The method as described in claim 1 wherein the fluid material is a gas.

15. A method for desulfurizing molten iron, comprising reacting sulfur to be removed with a nonmetallic rare earth compound, at a sufficiently low oxygen potential to form one of the group consisting of rare earth sulfides, rare earth oxysulfides, and mixtures thereof.

16. The method as described in claim 15 wherein the rare earth compound is selected from the group consisting of rare earth oxides, rare earth fluorocarbonates, rare earth oxyfluorides, and mixtures thereof.

17. The method as described in claim 15 wherein the molten iron contains carbon, and wherein the oxygen potential is maintained at a low level by reducing the partial pressure of carbon monoxide which forms by oxidation of carbon.

18. The method as described in claim 17 wherein the partial pressure of carbon monoxide is maintained below about 0.1 atmosphere.

19. The method as described in claim 15 wherein the rare earth sulfides and oxysulfides are reacted with oxygen to restore capacity for desulfurization.

20. A method for desulfurizing gases, comprising reacting sulfur to be removed with a nonmetallic rare earth compound, at a sufficiently low oxygen potential to form one of the group consisting of rare earth sulfides, rare earth oxysulfides, and mixtures thereof.

21. The method as described in claim 19 wherein the rare earth compound is selected from the group consisting of rare earth oxides, rare earth fluorocarbonates, rare earth oxyfluorides, and mixtures thereof.

22. The method as described in claim 20 wherein the rare earth sulfides and oxysulfides are reacted with oxygen to restore capacity for desulfurization.

23. The method as described in claim 20 wherein the sulfur to be removed is in the form of hydrogen sulfide.

24. A method for decreasing the hydrogen sulfide content of gases, comprising reacting at least a portion of the hydrogen sulfide with calcined bastnasite concentrate, at a sufficiently low oxygen potential to form one of the group consisting of rare earth sulfides, rare earth oxysulfides, and mixtures thereof.

* * * * *